United States Patent [19]

DiCenzo

[11] 4,101,105

[45] Jul. 18, 1978

[54] SHELVING STRUCTURE

[76] Inventor: Guy J. DiCenzo, 5650-C Via Romano, Charlotte, N.C. 28211

[21] Appl. No.: 754,331

[22] Filed: Dec. 27, 1976

Related U.S. Application Data

[62] Division of Ser. No. 599,767, Jul. 28, 1975.

[51] Int. Cl.[2] ..... F16M 13/00

[52] U.S. Cl. ..... 248/158; 108/110

[58] Field of Search ..... 108/108, 110, 106, 107, 108/109; 211/187, 190, 192, 207, 208, 136; 248/243, 158

[56] References Cited

U.S. PATENT DOCUMENTS

| | | | |
|---|---|---|---|
| 1,937,935 | 12/1933 | Zimmerman | 108/110 |
| 2,528,807 | 11/1950 | Whitney | 108/110 |
| 3,225,937 | 12/1965 | Amthor, Jr. | 108/110 X |

FOREIGN PATENT DOCUMENTS

| | | | |
|---|---|---|---|
| 671,886 | 10/1964 | Italy | 108/110 |
| 81,599 | 8/1934 | Sweden | 211/136 |

*Primary Examiner*—James T. McCall
*Assistant Examiner*—Peter A. Aschenbrenner

[57] ABSTRACT

A supporting post for shelving structure, which is right angular in cross section, both of the legs thereof having upwardly pointing prongs.

1 Claim, 15 Drawing Figures

FIG. 8
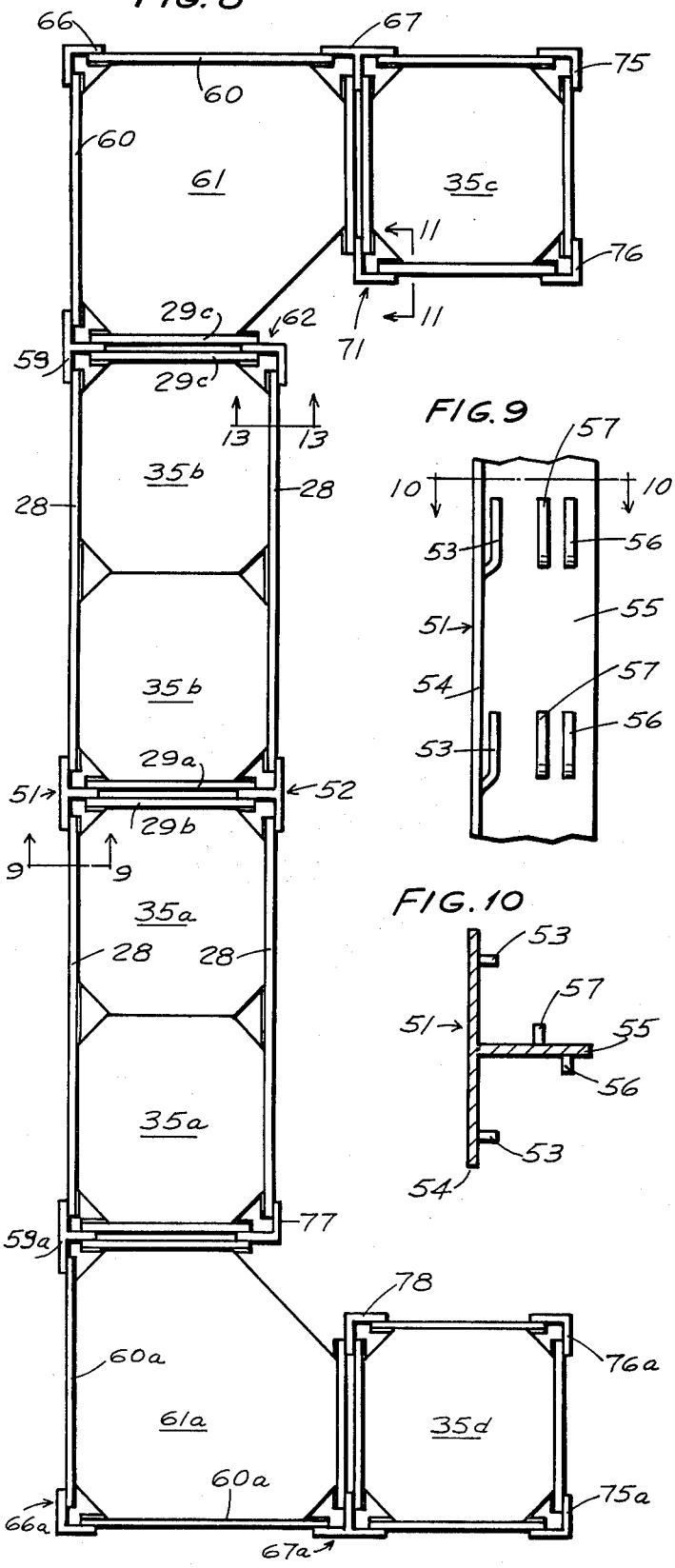
FIG. 9
FIG. 10
FIG. 11
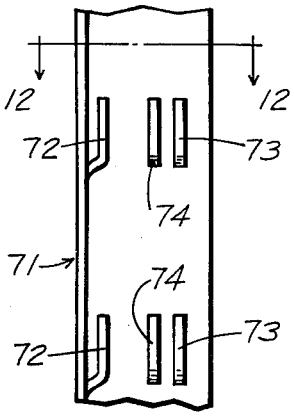
FIG. 12
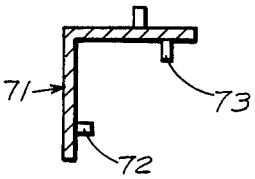
FIG. 13
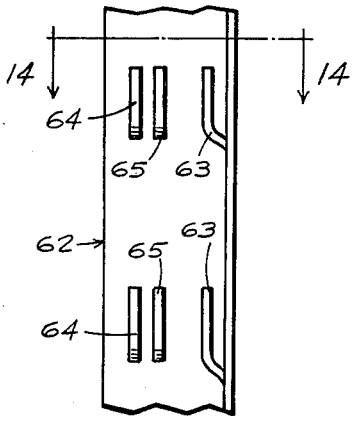
FIG. 14
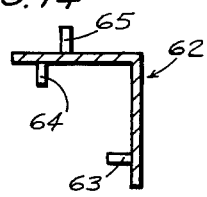

SHELVING STRUCTURE

This is a division of application Ser. No. 599,767, filed July 28, 1975.

This invention relates to shelving structures and particularly to ones which are readily assembled from individual, specialized parts without the need for attachment screws or bolts and nuts.

Also, the invention involves shelving structural parts which can be assembled into module units which are adapted to be joined together in a lengthwise end-to-end relationship or in an angular relationship. Another feature of the structural parts of this invention is that they lend themselves to shelving structures having horizontal or sloping shelves.

In the past, shelving structures have been devised which use parts which are to be put together to form a final assembly but they have been so complex or cumbersome that two persons, or more, have been required to complete the assembly. Many of the assemblies have lacked the rigidity which has been essential unless extensive bracing has been applied. Moreover, many of the prior art structural parts are designed to be combined in only one manner so that only one final asembly form can be made; they have lacked the flexibility which would permit different assembly forms.

The structural parts of the present invention are relatively few in number but they can be combined in a variety of manners. The shelves can readily be located at different heights and they can be horizontal or sloping. A shelf backing plate can be included and it can easily but firmly held in place. Modular units may be formed and they can be combined in numerous arrangements to suit the place where they will be located.

A foremost feature is that the parts can be assembled by one person with ease and the final construction is exceptionally rigid. Also, disassembly or rearrangement of the parts to form different module combinations is readily accomplished.

Figure 1:
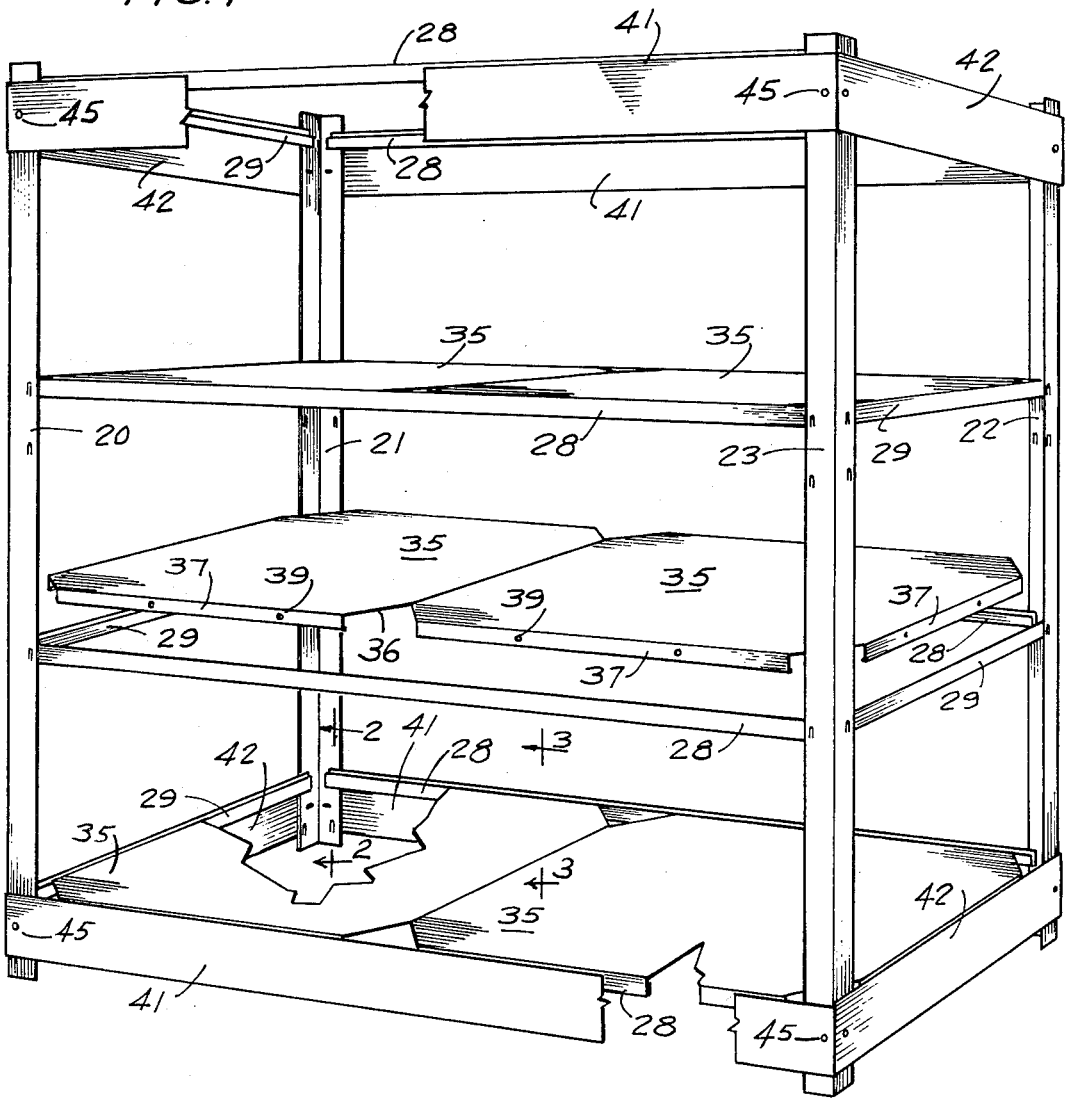
Figure 2:
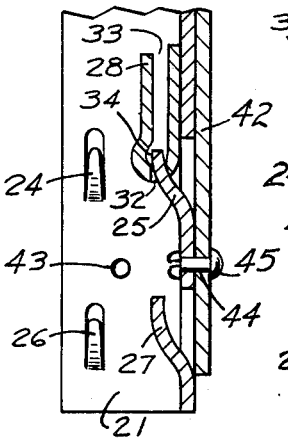
Figure 3:
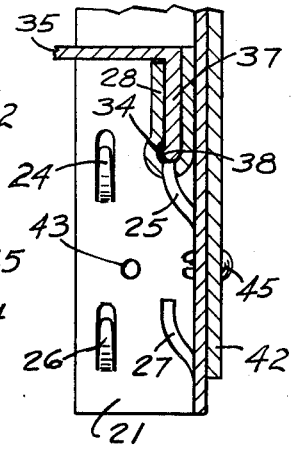
Figure 4:
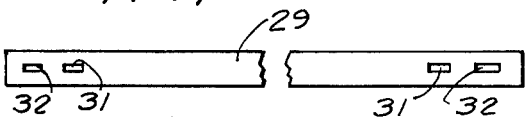
Figure 5:
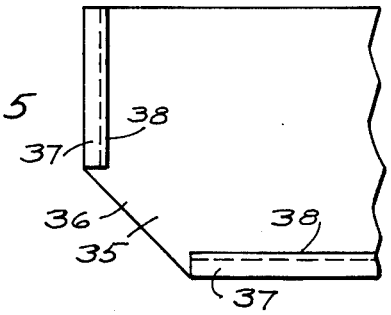
Figure 6:
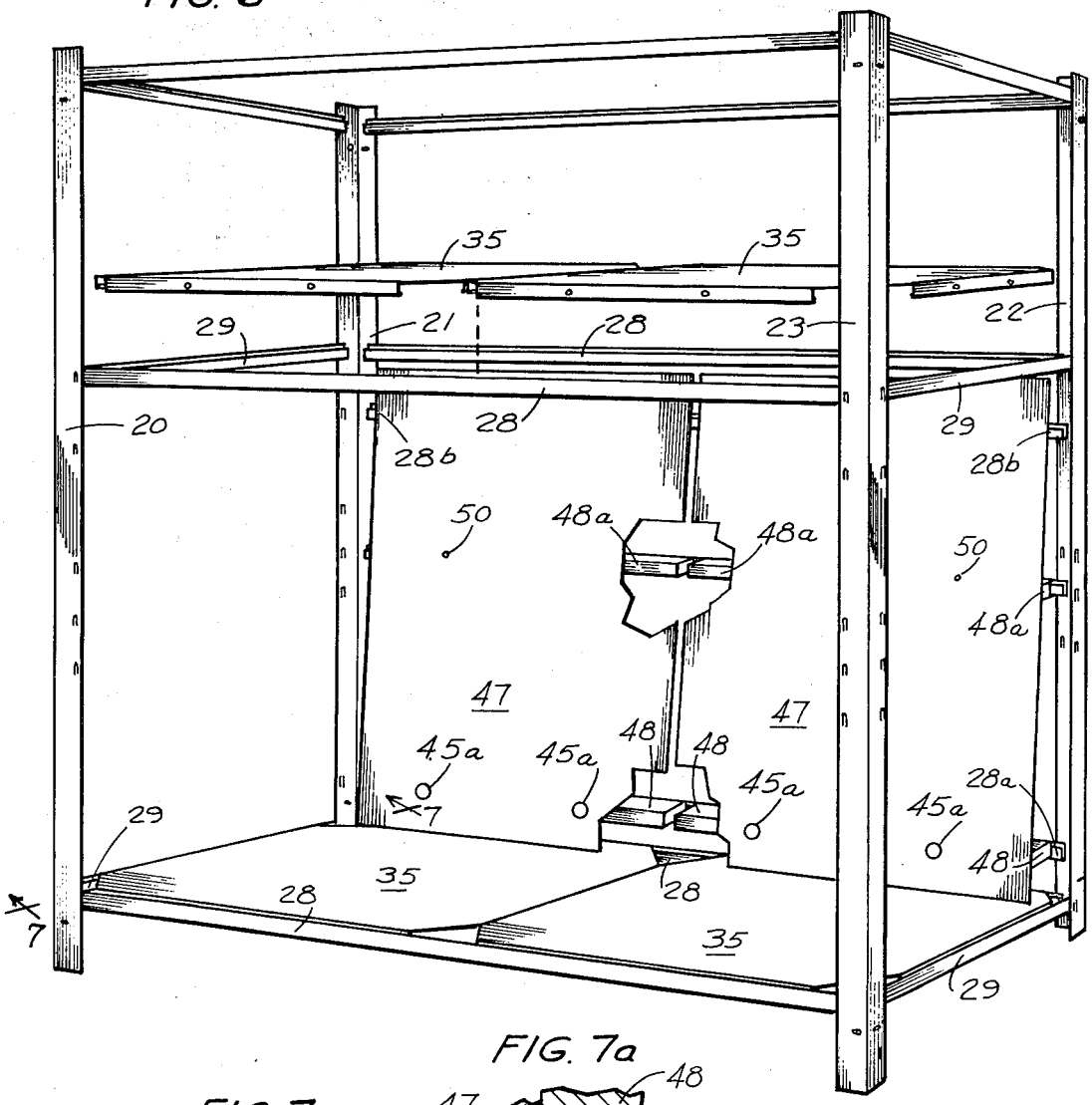
Figure 7A:
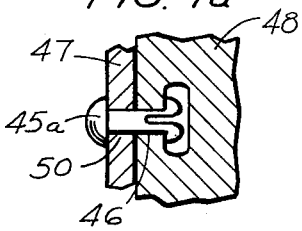
Figure 7:
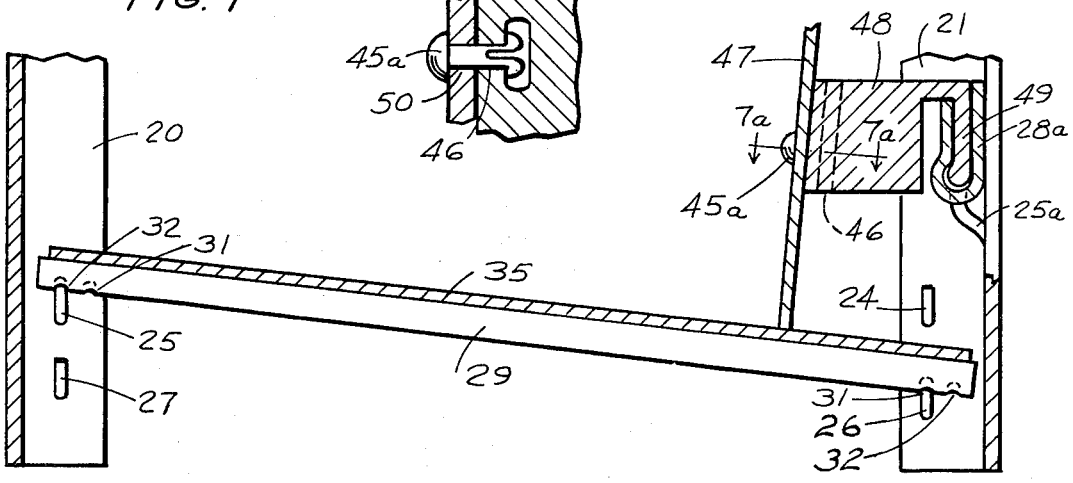

In the accompanying drawings:

FIG. 1 is a perspective view of a basic or standard shelving assembly, portions being broken away and some parts being separated to show the structure, FIG. 2 is a vertical sectional view on the line 2—2 of FIG. 1, to show the lower part of a corner post, FIG. 3 is a vertical sectional view on the line 3—3 of FIG. 1, to show the shelf interlock with a strut, FIG. 4 is a view of the under side of a strut, FIG. 5 is an under side view of a corner of a shelf, FIG. 6 is a perspective view of a basic shelving structure but having a sloping bottom shelf and a backing plate, the middle shelf being separated to better show the structure, FIG. 7 is a vertical sectional view on the line 7—7 of FIG. 6, FIG. *7a* is a horizontal view on the line *7a—7a* of FIG. 7, on an enlarged scale and of a fragmentary portion, FIG. 8 is a plan view of an endwise addition of the basic assembly to form an elongated structure and the combination with modified assembly units to form an angular structure, FIG. 9 is a vertical sectional view on the line 9—9 of FIG. 8, of only the lower part of the T post, FIG. 10 is a section on the line 10—10 of FIG. 9, FIG. 11 is a vertical sectional view on the line 11—11 of FIG. 8, of only the lower part of the post, FIG. 12 is a section on the line 12—12 of FIG. 11, FIG. 13 is a vertical sectional view on the line 13—13 of FIG. 8, of only the lower part of the post and FIG. 14 is a section on the line 14—14 of FIG. 13.

Referring first to FIGS. 1, 2 and 3, the four corner posts 20, 21, 22 and 23 are of identical construction but they have been given different reference numerals to simplify the subsequent description of the composite structure of FIG. 8. Each corner post is a so-called, angle iron, in that its cross section is a right angle or is of L shape and for strength it preferably is made of metal such as steel or aluminum but for a light construction it could be made of plastic. At intervals along the length of each post and on both of its legs, are struck-out cleats or clips and they open upwardly to form hook like prongs as is best shown in FIGS. 2 and 3. The opposing prongs 24 and 25 are at the same heighth on the two legs and slightly below them are the two opposing prongs 26 and 27, also at the same lower level. The prongs 24–25 lie on one horizontal plane and the prongs 26–27 lie in a lower horizontal plane. These prongs all are on the inner sides of the legs and the sets are formed at spaced intervals along the lengths of the posts.

For low cost construction, the prongs are pressed out of post material but they could, of course, be welded onto the posts or they could be moulded in place particularly if plastic were used. The spacing of the prongs determines the number and the levels of the shelves of the assembly. Also, the lengths of the corner posts is not critical as there may be only two shelves or the posts may go up to a ceiling heighth.

The corner posts are hooked or tied together by the struts or rails 28 and 29. The two long struts 28 are at the front and rear of the assembly and the two short struts 29 are at the ends of the assembly and as here shown the struts 28 are about twice as long as the struts 29. This makes up an oblong assembly but it is obvious that a square assembly would result if all the four struts were of the same length. The struts above each other are of the same lengths. The struts 28–29 in a plane are in an encircling arrangement.

The struts are of U shape in cross section and at their very bottom there are holes to receive the appropriate prong so that the struts are in a sense hooked onto the prongs and they thereby tie together and mutually support the corner posts. As is shown in FIG. 4 the short struts 29 are formed with an inner pair or holes 31 and also with an outer pair of holes 32 for purposes to be explained. The longer struts 28 need have only an outer pair of holes like 32 in FIG. 2.

As is stated above, the struts are U shaped in cross section and the side walls are relatively closely spaced so that there is a narrow entrance or slit passageway 33 between them. At the bottom of this passageway the slit widens out at 34 so that there is an enlarged space along the length of the strut at the depth or deep end of the passageway 33. This is best shown in FIGS. 2 and 3.

The shelves 35 are plates which are here shown to be each of square size, and each of its four corners is diagonally cut off at 36 so as to not interfere with the prongs or hooks 24–27 which may be at that corner. Depending from the four sides of each shelf 35 is peripheral flange 37 which is of a size to snugly fit in the slit passageway 33 of the struts 28 and 29. The remote edge of the flanges 37 is formed with a bulbous enlargement or heading 38 along their entire inner sides as is shown in FIG. 3. This same figure shows that this beading 38 fits into the lower enlargement 34 of the passageway 33 and it is this interengagement which resists removal of the shelf 35 after it has been positioned in place in the struts 28 and 29.

The shelves 35 are preferably square, as stated above, as this makes them interchangeable as to their orientation and assembly. The corner posts could be connected only by the shorter struts 29 so that only a single shelf 35 would be used at each level but with the long struts 28, two shelves fit side by side to form an elongated shelf area. It is for this reason that the struts 28 are about twice as long as the struts 29. The flanges 37 are formed with holes 39 so that where they lie against each other at the middle of the shelf area, bolts may be passed through them to give added strength and firmness to the assembly.

To put together the assembly of FIG. 1, one procedure is to lay the two rear posts 21 and 22 on the ground and hook all of the back struts 28 in place on the prongs at the selected levels for the shelves. Then the two front posts 20 and 23 are laid on the ground and the front struts 28 are hooked onto the corresponding prongs. Then these two subassemblies are brought upright and the short struts 29 are hooked in place. If all the corresponding hooks or prongs have been selected, the struts 28 and 29 will encircle the structure at the same levels. Thereafter, the shelves 35 are pressed fully into slits 33 of the struts and the assembly is complete. One person can accomplish this entire assembly and no bolts or screws are required.

The location of the shelf flanges 37 in the slits in struts 28 and 29 serves to strengthen this part of the assembly, especially if the interlock at 34–38 is provided. This strong assembly between the shelf and strut serves to establish a strong connection between the shelves and the posts.

The invention contemplates the addition of sign or logo plates to the assembly. These include the long plates 41 for the front and back and the short plates 42 for the ends of the assembly. These plates have holes 44 at their ends which register with holes 43 at the tops and bottoms of the corner posts. Snap pins 45 or like fastening articles such as clevice pins or even bolts and nuts may be used to attach the logo plates to the posts. The snap pins 45 are probably the easiest to use as they have a pointed, bifurcated end which collapses as it is pushed into the holes 43 and 44 and which reopens to retain itself in place.

In the assembly of FIG. 1 the shelves are horizontal as the selected prongs 24–25 or 26–27 lie in horizontal planes. To make this clear it may be pointed out that the back strut 28 for the lowest shelf is hooked on the prong 25 of post 21 and on the prong 24 of post 22. The front strut 28 is hooked on the prong 25 of post 23 and on prong 24 of post 20. The lefthand strut 29 is hooked on the prong 25 of post 20 and the prong 24 of post 21, making sure that the innermost holes 31 are used. The lefthand strut 29 is hooked on the prong 25 of post 22 and on prong 24 of post 23, again making sure that the innermost holes 31 are used. The spacing between the holes 31 is such that the flanges 37 of the shelves 35 will precisely fit into the passages 33 of the front and back struts 28. The flanges 37 at the outermost ends fit in the passages of the struts 29.

If, instead of horizontal shelves, sloping shelves are desired, the invention includes provisions for facilitating this, as is shown in FIGS. 6 and 7. The front strut 28 is hooked on upper prong 24 of post 20 and on upper prong 25 of post 23 but the rear strut 28 is hooked on the lower prong 27 of post 21 and also on the lower prong 26 of post 22. This means that the rear strut 28 is lower than the front strut 28 and that the end struts 29 should both slope rearwardly and downwardly. To accomplish this the left strut 29 (see FIG. 7) is hooked on upper prong 25 of post 20, making sure to use outer hole 32, and it is hooked on lower prong 26 of post 21, but making sure that the inner hole 31 is used. The right hand end strut 29 is hooked on lower prong 27 of post 22 and on upper prong 24 of post 23.

The outermost holes 32 of the end struts 29 are spaced just the correct distance away from holes 31 so that the additional distance between prongs 25 and 26 is compensated for and the front and back struts 28 will be spaced apart the proper distance to receive the shelf flanges 37. The actual distance that the outer holes 32 are away from holes 31 is, of course, determined by the distance that the lower prongs 26 and 27 are below the upper prongs 24 and 25. Any shelf from the top to the bottom can be set up in this manner so that it slopes from front to rear upwardly or downwardly. If the assembly of FIG. 1 has initially been made and it is desired to slope one of the shelves, an adjustment of only that one shelf is necessary. The two long struts 28 can, of course, slope if appropriately spaced holes are formed in their lower edges.

To prevent the articles which are placed on the sloping shelf of FIGS. 6 and 7 from moving backwardly and falling off of the rear of the shelf, the invention includes two back plates 47. They rest on the shelf 35 as shown in FIG. 7 and they slope upwardly and rearwardly. At their top edges the plates 47 rest against a strut identified as **28*b*** which is hooked on the proper prongs on the two rear corner posts.

As friction along may not prevent the slippage movement of plate 47 on the shelves 35, a backing brace or strip may be used. It includes an integral flange portion 49 which corresponds to the flange 37 of the shelves 35 and a body portion 48. The depth of the body portion 48 is sufficient to fill the space to the back plates 47 so that the back plates rest against it. The flange 49 is parallel to the body portion 48 and snaps in the slit or passageway of the strut identified as **28*a*; struts 28*a* and 28*b* are identical to the struts 28 described above. The strut 28*a* is hooked onto prong 25*a* of post 21 and on a like prong on post 22. These latter prongs are identical to prongs 24–27** which are spaced at a multiplicity of places along the lengths of the corner posts.

To further provide backing support for the back plates 47 along their heights, additional backing braces or strips may be provided. Such a one is identified at **48*a* and it has a depth less than the depth of brace 48, to just fill the space at that point behind the back plates. Several such backing braces may be provided at different heights, each one being of the necessary depth for the back plates to bear against. The back plates 47 can, of course, be vertical, in which case the body portions 48** at all heights would be of the same depth.

Holes 50 are formed in the back plates 47 for the insertion of snap pins **45*a* (preferably identical to 45) to engage the backing brace 48 as shown in FIG. 7*a*, to hold the plates and prevent their slippage forward. The pins 45*a* engage in vertical slots 46 which are in alignment with the holes 50, the slots 46 being enlarged at their far depths to form shoulders that the bifurcated ends of the snap pins 45*a* bear against. (See FIG. 7*a***).

In FIG. 6 the logo or sign plates 41 and 42 have been omitted to clarify the drawing but they may be applied in the same manner which is shown in and described for the structure of FIG. 1. The back plates 47 may be shorter or longer in heighth than the ones shown in FIG. 6. Or, there may be more than one sloping shelf in a single assembly, each with its own back plate.

The invention also includes the modified corner posts shown in FIGS. 9 to 14 inclusive which may be substituted for the corner posts 20–23 so that the elongated and/or angular structure of FIG. 8 may be put together. In this FIG. 8 the two shelf plates 35*a*, 35*a* correspond to the two shelf plates 35, 35 in the standard structure of FIG. 1; also the two shelf plates 35*b*, 35*b* correspond to the two shelf plates 35, 35. Thus, two standard assemblies of FIG. 1 can be joined end to end by omitting the four corner posts when they would come together and by replacing them with the two T posts 51 and 52.

To clarify this, the corner posts 20 and 21 of one assembly and the corner posts 22 and 23 of another assembly would be replaced by the T posts 51 and 52 so that the two assemblies will be tied together by these T posts. As is shown in FIGS. 9 and 10, the back strip 54 of the T post has prongs 53 struck out from it on both sides of the center leg or strip 55. They are spaced along the post the same distance that prongs 24 and 26 are spaced apart. Prongs 56 are struck out of one side of the center strip 55 and prongs 57 are struck out from the other side. A prong 56 and the prong 57 beside it form a pair. The front and rear struts 28 of the standard assembly are hooked onto the adjacent prongs 53.

The prongs 56 and 57 are at different distances from the back strip 54 (see FIG. 10) to provide the necessary body material, and this spacing corresponds to the distance between the holes 31 and 32. Consequently, the hole 31 at one end of strip 29*a* is hooked on prong 57 of post 51 and the hole 32 at the other end is hooked on the prong 56 of post 52. This is true, in reverse, for the end strip 29*b* and thus identical end strips 29 can be used in the end-to-end assembly of 35*a*, 35*a* to 35*b*, 35*b*. If only these two standard sections are to be connected together the standard L shaped corner posts at the extreme ends are used. Thus, at the outer end of shelves 35*a*, 35*a* the corner posts 20 and 21 would remain and at the outer end of shelves 34*b*, 35*b* the corner posts 22 and 23 remain.

As many of the standard assembly of FIG. 1 may be joined together, end to end, in this manner, as are desired to fit a particular situation. The identical kind of T post is used where the ends of the adjacent standard sections come together.

Another feature of the invention is that the shelving may be extended into a right angular arrangement as is shown at both the top and at the bottom of FIG. 8. Referring first to the top of this figure, this includes the addition of the corner shelf 61 and the end shelf 35*c*. At this point it may be mentioned that the shelf plate 35*c* is identical to the shelf plate 35 but that the corner shelf 61 is larger. The corner shelf 61 is preferably square and has a depending flange corresponding to flange 37, as well as cut away corners like 36.

To make this addition possible, another T post 59 is used, which is identical to T post 51 and 52. To it are attached the two struts 29*c*, 29*c* and the other ends of these struts are hooked onto the special corner post 62 which is shown in FIGS. 13 and 14. This post 62 is of L shape in cross section and pressed inwardly of one of its legs are the prongs 63; strut 28 which supports the shelves 35*b*, 35*b* is hooked on this prong 63. The other leg of the special corner post 62 has pressed inwardly from it the prongs 64 and pressed outwardly from it the prongs 65. The double pairs or sets of holes 31 and 32 in struts 29*c*, 29*c* make it possible to hook these struts in place on the prongs 64 and 65.

At the upper left corner of FIG. 8 the corner post 66 is a standard one like those in FIG. 1. The T post 67 is the same as that at 51, 52 and 59. The two long struts 60 are hooked in place as they have holes like 32 and they are larger than end struts 29 to accommodate plate 61 which is larger in size than plate 35 as has been stated above. This provides a wide entrance between the post 62 and the adjacent post 71 to facilitate putting articles on this end, corner plate 61.

The special corner post 71 may be regarded as a left-hand version of the right-hand post 62 which has been described as a special corner post. As is shown in FIGS. 11 and 12, one leg of the post 71 has inwardly struck prongs 72 and the other leg has inwardly struck prongs 73 and also outwardly struck prongs 74. The two struts which join posts 67 and 71 are the standard ones of FIG. 1 and the inner holes 31 are used. The other three struts which support the end shelf plate 35*c* are the same as strut 29 in FIG. 4. The two corner posts 75 and 76 are the standard ones used in the assembly of FIG. 1.

In FIG. 8 only a single shelf 35*c* is shown to illustrate the versatility of the structural parts. If desired, this end section can be elongated into a standard assembly of FIG. 1 by adding another shelf plate and using the long front and rear struts 28 which are used in FIG. 1. It is apparent that still another complete assembly of FIG. 1 can be added at the end by replacing the two corner posts 75 and 76 with T posts and adding the other necessary parts.

At the bottom of FIG. 8 another angular extension has been added; this includes the large shelf plate 61*a* which is identical to shelf plate 61 and includes the end shelf plate 53*d* which corresponds to 35*c*. The assembly of the parts is believed to be self evident from the drawing and the above description but it is important to note that the special corner post 77 is the same as post 71 and that the special corner post 78 is the same as post 62. The other posts for shelves 61*a* and 35*d* have the subscript *a* added to the reference numeral which identifies the corresponding post at the top of FIG. 8.

The relatively few parts which are included in the invention lend themselves to other variations in the assembled structure. For instance the shelves 35*a*, 35*a* can be sloped downwardly, forwardly or rearwardly as has been explained without changing any other parts of the assembly. Another possible variation is to use only a single shelf plate at each shelf level in FIG. 1 and to use only the short struts 29, to make a square assembly. Other variations in the assembly of the parts should be obvious.

Free access is had to both sides of the shelving assembly if it is located away from a wall. This accessibility is true of the arrangement of FIG. 8, from both the inside of the U-shaped layout as well as from the outside of the layout. By proper selection of the module units they can be assembled as a complete enclosure around a post, thus making excellent use of floor space. In FIG. 8 the corner plate 61 can be quite large so as to open up a wide entrance space between posts 62 and 71. This requires longer struts 60 and a larger cut-off corner between posts 62 and 71.

I claim:

1. A supporting post for shelving structure, which is right angular in cross-section, both of the legs thereof having upwardly pointing prongs on their inner sides and one of the legs also having an upwardly pointing prong on its outer side, all of the prongs being at the same relative distance along the length of the post so that they are aside of each other.

* * * * *